US008152362B2

(12) United States Patent
Uhlenkamp et al.

(10) Patent No.: US 8,152,362 B2
(45) Date of Patent: Apr. 10, 2012

(54) MIXER AND METHODS OF MIXING

(75) Inventors: Brian J. Uhlenkamp, Sauk Centre, MN (US); Shawn P. Pitt, St. Cloud, MN (US)

(73) Assignee: DCI, Inc., St. Cloud, MN (US)

( * ) Notice: Subject to any disclaimer, the term of this patent is extended or adjusted under 35 U.S.C. 154(b) by 427 days.

(21) Appl. No.: 12/580,396

(22) Filed: Oct. 16, 2009

(65) Prior Publication Data

US 2010/0097882 A1 Apr. 22, 2010

(51) Int. Cl.
*B01F 11/00* (2006.01)

(52) U.S. Cl. ..... 366/277; 366/243; 366/278

(58) Field of Classification Search ..... 366/241–243, 366/276–278, 289; 72/20, 21
See application file for complete search history.

(56) References Cited

U.S. PATENT DOCUMENTS

| | | | | | |
|---|---|---|---|---|---|
| 72,673 | A | | 12/1867 | Pelsor | |
| 519,584 | A | * | 5/1894 | Michell | 366/278 |
| 699,521 | A | | 5/1902 | Heinrichs | |
| 1,649,564 | A | * | 11/1927 | Boettcher | 366/93 |
| 1,983,788 | A | | 12/1934 | Brennan | |
| 1,995,998 | A | | 3/1935 | Nefedov | |
| 2,229,238 | A | | 1/1941 | Cash | |
| 2,595,793 | A | | 5/1952 | Kay | |
| 3,955,802 | A | | 5/1976 | De Bruyne | 259/117 |
| 3,998,435 | A | | 12/1976 | De Bruyne | 259/114 |
| 4,023,780 | A | | 5/1977 | Egid | 259/102 |
| 4,501,196 | A | * | 2/1985 | Loichinger et al. | 366/261 |
| 5,052,892 | A | | 10/1991 | Fasano | 416/204 R |
| 5,316,443 | A | | 5/1994 | Smith | 416/197 R |
| 5,791,780 | A | | 8/1998 | Bakker | 366/317 |
| 5,941,635 | A | | 8/1999 | Stewart | 366/165.5 |
| 6,523,995 | B2 | | 2/2003 | Fasano et al. | 366/264 |
| 6,634,784 | B2 | | 10/2003 | Blakley | 366/330.2 |
| 6,796,707 | B2 | | 9/2004 | Gigas et al. | 366/327.1 |
| 6,808,306 | B2 | | 10/2004 | Weetman | 366/302 |
| 6,860,474 | B2 | | 3/2005 | Blakley et al. | 261/87 |
| 6,877,750 | B2 | | 4/2005 | Engel | 277/637 |
| 6,883,960 | B2 | | 4/2005 | Reeder et al. | 366/243 |
| 6,935,771 | B2 | | 8/2005 | Engel | 366/331 |
| 7,001,063 | B1 | | 2/2006 | Markle | 366/168.1 |
| 7,153,021 | B2 | | 12/2006 | Goodwin et al. | 366/273 |

(Continued)

OTHER PUBLICATIONS

ATMI LifeSciences, Newmix®—Levtech® Pad-Drive™, 2008, Datasheet, 4 pages.

*Primary Examiner* — Walter D. Griffin
*Assistant Examiner* — Timothy Cleveland
(74) *Attorney, Agent, or Firm* — Alan Kamrath; Kamrath IP Lawfirm, PA

(57) ABSTRACT

A mixer (10) includes a coupler (22) receiving an upper end of a shaft (24) rotatably connected to an offset pin (20) of a circulating plate (18) mounted to a rotatable output (14) of a motor (12). The shaft (24) is slideably mounted by a linear bearing (40) to a swivel plate (32) which is mounted to swivel relative to a support rod (106). Due to the non-parallel angle (C) of the offset pin (20) to the rotatable output (14), the shaft (24) and a paddle (30) mounted thereto moves up and down, rotates about the offset pin (20) and swivels at swivel angles (A, B) in first and second planes in a multi-direction which is angular and non true circular.

20 Claims, 5 Drawing Sheets

U.S. PATENT DOCUMENTS

| | | | | |
|---|---|---|---|---|
| 7,249,880 | B2 | 7/2007 | Zambaux | 366/277 |
| 7,278,780 | B2 | 10/2007 | Goodwin et al. | 366/273 |
| 7,377,686 | B2 | 5/2008 | Hubbard | 366/208 |
| 7,407,322 | B2 | 8/2008 | Engel | 366/274 |
| 7,431,494 | B2 | 10/2008 | Zambaux | 366/144 |
| 2005/0239199 | A1 | 10/2005 | Kunas et al. | 435/297.1 |
| 2006/0065310 | A1 | 3/2006 | West et al. | 137/590 |
| 2006/0280028 | A1 | 12/2006 | West et al. | 366/331 |

* cited by examiner

MIXER AND METHODS OF MIXING

BACKGROUND

The present invention relates to a mixer and methods of mixing and, more particularly, to a mixer and mixing methods that provide a multi-direction, angular, non true circular movement pattern creating a circular type flow capable of mixing and maintaining homogeneity in the product being mixed.

Mixers generally "pump" product within a confined area to mix product additions and maintain homogeneity. Mixers currently available on the market include standard tank mixers with propellers and single-use (or disposable) mixers. Most standard tank mixers are of the top-entering type and include a rotating shaft entering from the top into a tank where mixing occurs and an impeller attached to the rotating shaft for mixing purposes. Bottom magnetic type mixers can perform mixing without intrusion into the tank but have an impeller/bearing assembly in contact with the product. Other standard tank mixers provide a simple back-and-forth motion for mixing. Single-use, top-entering type mixers normally include a shaft/blade that provides a simple back-and-forth or oscillating motion. A flexible boot in a top of a bag allows entrance and containment of the shaft/blade. The shaft/blade is sometimes covered with a bag so that there is no product contact or intrusion into the product. As for a single-use bottom magnetic/levitating mixer, a single-use blade is located inside the bag and basically operates in the same concept as standard tank mixers. However, the shafts/blades of all conventional mixers can not always provide homogeneity in the product.

In an approach to provide more homogenous mixing, the mixer includes a continuously rotating mixing paddle which is subjected to both rotative and swingable oscillation about a transverse axis to produce a non-repeating, spherically-orientated mixing path resembling a series of radially-disposed overlapping lobes. In another approach, the mixer includes a non-rotating elongated arm extending through an opening in the top of a tank, with the arm pivoted for movement about a pivot axis. Furthermore, an impeller is positioned on the arm for movement therewith and within the tank, with the impeller moving back and forth along an arcuate path within the tank as the arm pivots back and forth about the pivot axis. Further, a ball-and-socket assembly is positioned above the top of the tank and movable along a curved path to move the impeller in a curved path within the tank. However, the mixing results of these two approaches are still unsatisfactory.

Thus, a need exists for a mixer that provides a movement pattern creating a circular type flow capable of mixing and maintaining homogeneity in the product being mixed.

SUMMARY

The present invention solves this need and other problems in the field of mixers by providing, in a preferred form, a novel mixer and its mixing methods.

In a first aspect of the present invention, a mixer provides a multi-direction movement pattern for a shaft, creating a circular type flow capable of mixing and maintaining homogeneity in the product being mixed.

In another aspect of the present invention, the mixer can perform mixing in single-use bags without contact with the product and without intrusion of the bags.

In a further aspect of the present invention, the mixer can be utilized as a standard tank/vessel mixer without a single-use bag.

In still another aspect of the present invention, the mixer can be utilized in sanitary industries such as food, beverage, dairy, bakery, cosmetic, pharmaceutical, and biotech as well as in additional industries such as chemical.

In most preferred forms, the upper end of a shaft is moved in two directions perpendicular to the shaft while the lower end having a paddle is received in product to be mixed and received in a compartment defined by the tank. The shaft is slideably mounted in a direction parallel to the shaft to a swivel plate in turn moveably mounted and in most preferred aspects mounted in a swiveling manner to a support axis for movement in at least one direction perpendicular to the shaft. In most preferred forms, a coupler receiving the upper end of the shaft is rotatably mounted about an offset axis to a circulating plate rotatably mounted about an output axis, with the offset axis being spaced from and at a non-parallel angle to the output axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
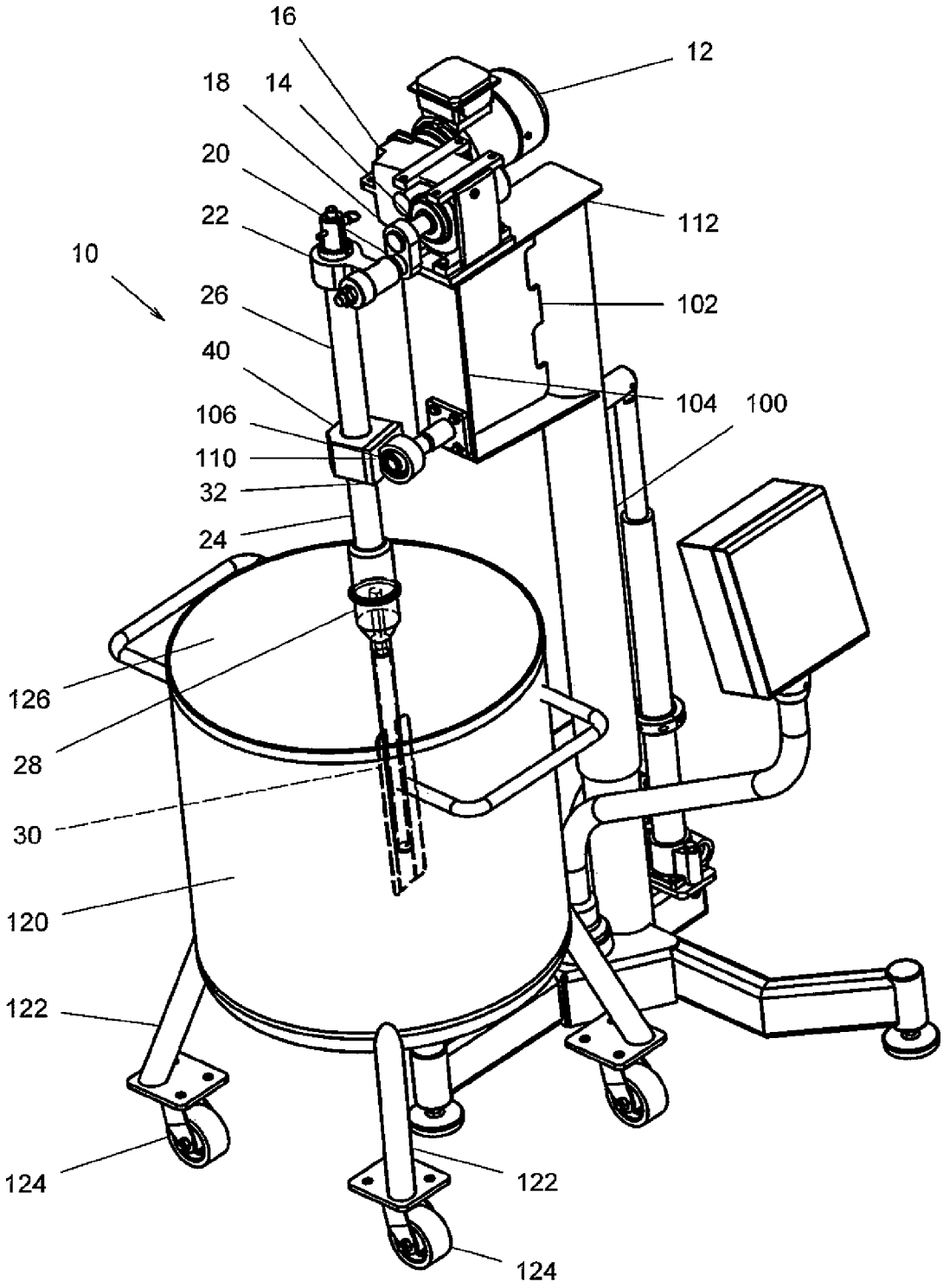
FIG. 1 shows a perspective view of a tank and a mixer according to the preferred teachings of the present invention.
Figure 2:
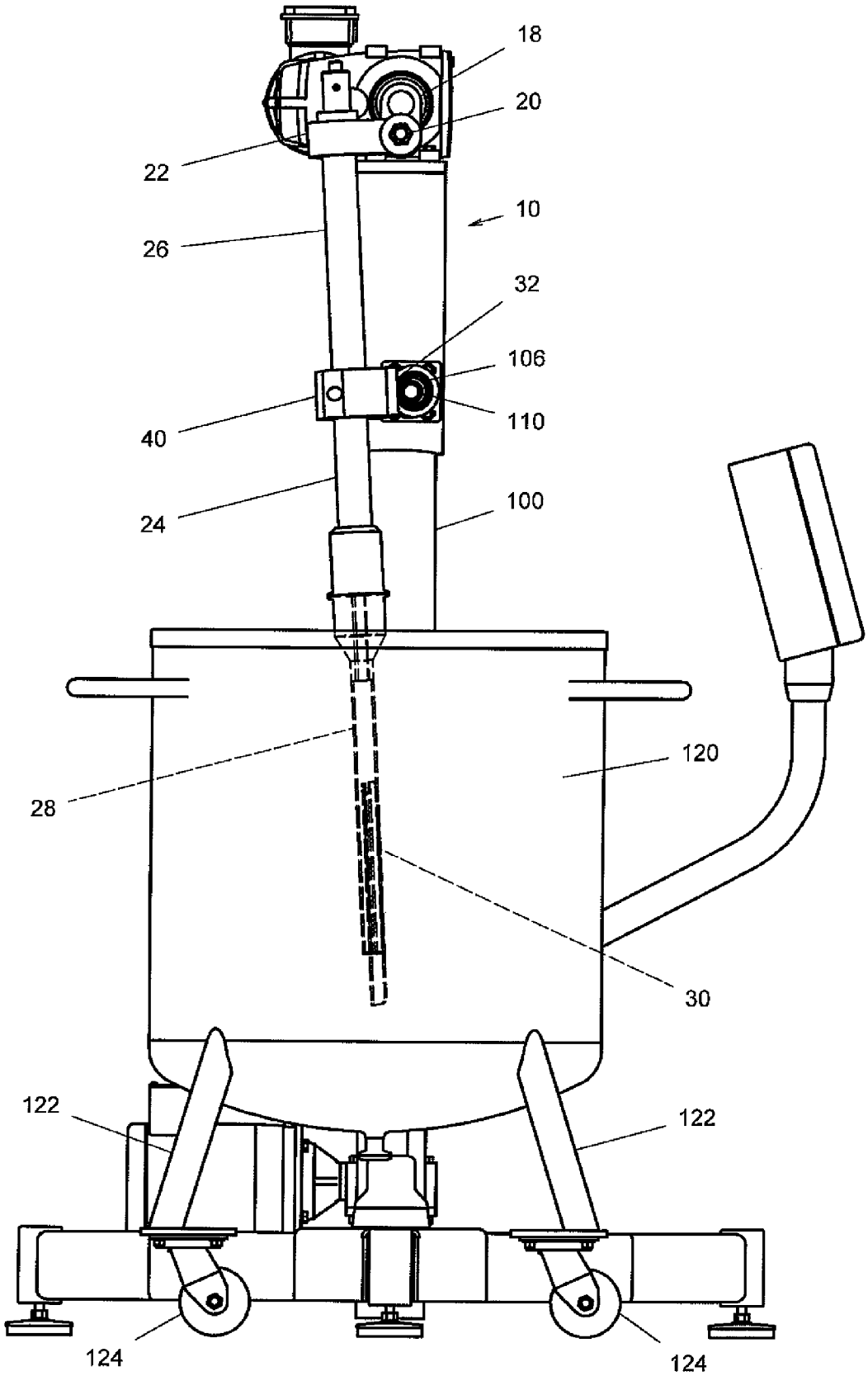
FIG. 2 shows a front, elevational view of the mixer of FIG. 1.
Figure 3:
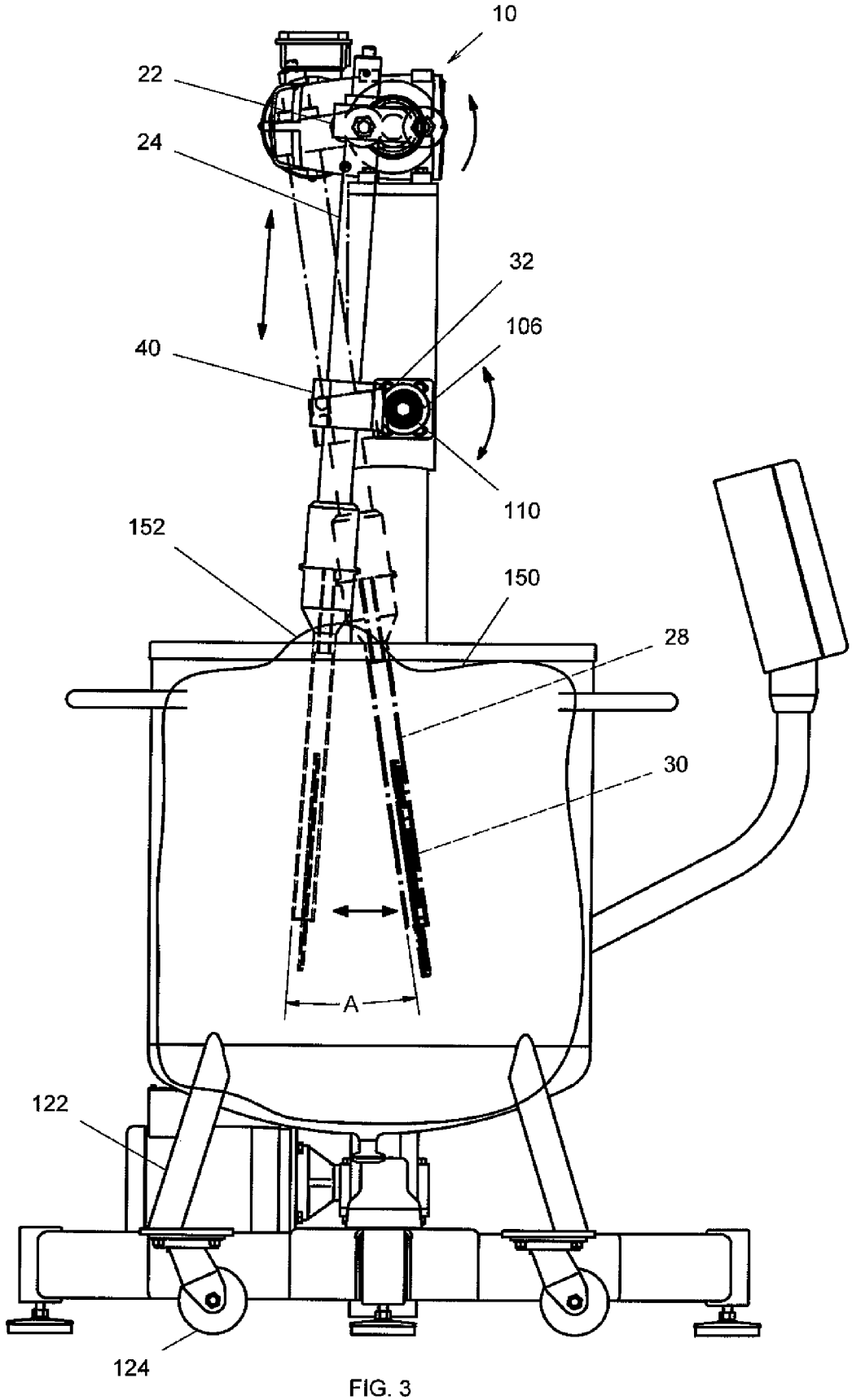
FIG. 3 shows a partial, side elevational view of a portion of the mixer of FIG. 1, illustrating movement of a shaft of the mixer.
Figure 4:
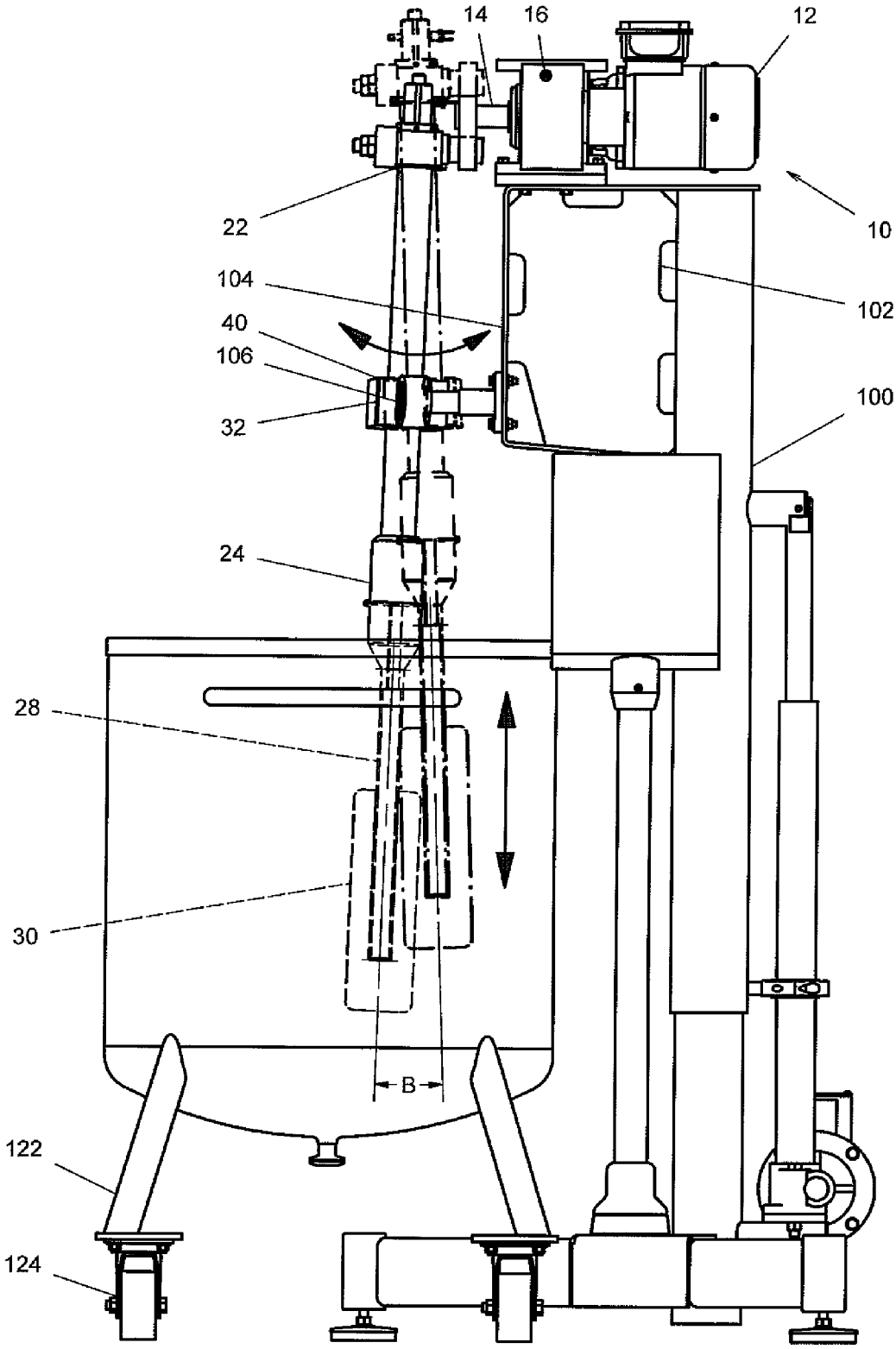
FIG. 4 shows a partial, front, elevational view of a portion of the mixer of FIG. 1, illustrating movement of the shaft of the mixer.

All figures are drawn for ease of explanation of the basic teachings of the present invention only; the extensions of the figures with respect to number, position, relationship, and dimensions of the parts to form the preferred embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "first", "second", "third", "upper", "lower", "end", "portion", "section", "horizontal", "vertical", and similar terms are used herein, it should be understood that these terms have reference only to the structure shown in the drawings as it would appear to a person viewing the drawings and are utilized only to facilitate describing the illustrative embodiments.

DESCRIPTION OF THE PREFERRED EMBODIMENTS

A mixer according to the preferred teachings of the present invention is shown in the drawings and generally designated 10. According to the preferred form shown, mixer 10 is supported by a frame 100 placed on the ground. Frame 100 includes a horizontal beam 102 extending horizontally from an upper section of frame 100. A distal end of horizontal beam 102 is interconnected to an intermediate portion of a side of a vertical beam 104. An upper end of vertical beam 104 is fixed to a mounting plate 112 fixed on top of frame 100. A support rod 106 extends from the other side of vertical beam 104 along a support axis. A tank 120 is provided adjacent frame 100 and below support rod 106. Tank 120 includes a plurality of legs 122 each having a caster 124 attached to a lower end thereof to allow maneuverability when desired. Tank 120 defines a compartment 126 receiving product to be mixed. Frame 100 can be adjustable in height responsive to the height of tank 120. It can be appreciated that mixer 10 according to the teachings of the present invention can be utilized with frame 100 and tank 120 of other forms and structures.

According to the preferred form shown, mixer 10 includes a motor 12 in the most preferred form shown as a gear motor having a rotatable output 14 rotatably received in a housing 16 and being fixed on mounting plate 112. Rotatable output 14 includes an output axis parallel to and spaced from the support axis in the vertical direction. A circulating plate 18 is attached to a distal end of rotatable output 14 to rotate therewith. An offset pin 20 extends from a side of circulating plate 18 in a direction generally parallel to and spaced from the output axis of rotatable output 14. A coupler 22 has an end rotatably coupled to a distal end of offset pin 20. Coupler 22 generally extends in a direction perpendicular to an offset pin axis defined by offset pin 20. The other end of coupler 22 is enlarged to securely receive an upper end of a shaft 24 having a shaft axis perpendicular to the extending direction of coupler 22. Thus, the offset pin axis extends through coupler 22 spaced generally perpendicular from shaft 24. According to the most preferred form shown, shaft 24 includes an upper section 26 and a reduced, lower section 28 having a lower end opposite to the upper end and to which a paddle 30 is attached. The lower end, lower section 28 and paddle 30 extend from the top of tank 120 into compartment 126.

According to the preferred form shown, mixer 10 further includes a swivel plate 32 having a first side coupled to a distal end of support rod 106 by a swivel joint 110. Thus, swivel plate 32 can move and swivel relative to support rod 106 and is allowed to pivot about the support axis in directions perpendicular to shaft 24. A linear bearing 40 is mounted to the other side of swivel plate 32 opposite to swivel joint 110. Upper section 26 of shaft 24 is slideably extended through linear bearing 40, with shaft 24 intermediate the upper and lower ends being slideably mounted to swivel plate 32 by linear bearing 40 along shaft 24 defining the shaft axis.

Now that the basic construction of mixer 10 according to the preferred teachings of the present invention has been set forth, a method of operation can be explained, and some of the advantages obtained thereby highlighted. In particular, for the sake of explanation, it will be assumed that a bag 150 is placed in compartment 126 of tank 120 and includes a flexible boot 152. Product to be mixed is placed in bag 150. Lower section 28/paddle 30 of shaft 24 extends through boot 152 into bag 150. Motor 12 is activated to rotate rotatable output 14 and circulating plate 18 about the output axis of rotatable output 14. Since upper end of shaft 24 is coupled via coupler 22 to offset pin 20, shaft 24 moves in two directions perpendicular to shaft 24 and particularly oscillates up and down generally perpendicular to the output axis of rotatable output 14 and rotates about the offset pin axis. Furthermore, shaft 24 slides up and down along a linear bearing or shaft axis in linear bearing 40 and transmits linear motion to linear bearing 40 which, in turn, causes swivel movement of linear bearing 40/swivel plate 32 relative to swivel joint 110. According to the most preferred form shown, the swivel angle A of swivel plate 32 relative to the support axis defined by support rod 106 in a first plane perpendicular to the support axis is in a range of 5°-35° and in the most preferred form is 12.8°, and the paddle 30 fixed to shaft 24 has a swaying angle B in a second plane perpendicular to the first plane in a range of 0°-15° and in the most preferred form is 4° while paddle 30 moves up and down together with shaft 24. Furthermore, a lower end of shaft 24 moves in a third plane generally perpendicular to support rod 106. Movement of shaft 24 in the third plane is simultaneous in two directions in the third plane due to offset pin 20 that moves in a circular path. Thus, a multi-direction movement (angular, and non true circular) pattern is provided. Specifically, paddle 30 moves in multidirections and resembles a person mixing paint with a paint stick or a person mixing ingredients in a bowl and giving similar mixing characteristics. This pattern creates a circular type flow capable of mixing and maintaining homogeneity in the product being mixed. Thus, mixer 10 according to the preferred teachings of the present invention provides multi-direction mixing action. Paddle 30 of mixer 10 according to the preferred teachings of the present invention oscillates in more than one plane. Particularly, paddle 30 performing the mixing action has up and down action, back-and-forth movement, oscillation, and angular tilting in more than one direction. Thus, the movement of paddle 30 is different from conventional mixers that move in one or two directions only. Furthermore, the multi-direction mixing action lifts the product, which is different from conventional mixers. Further, lower section 28/paddle 30 of shaft 24 of mixer 10 according to the preferred teachings of the present invention entering bag 150/tank 120 moves linearly rather than rotationally that is common in conventional mixers. It can be appreciated that this multi-direction movement is repeatable for consistency and validation purposes.

Mixer 10 according to the preferred teachings of the present invention can perform mixing in tanks and/or bags. Particularly, mixer 10 according to the preferred teachings of the present invention can be utilized with tanks of differing shapes including but not limited to round, square, rectangular, etc. Also, mixer 10 according to the preferred teachings of the present invention can be utilized with bags of differing shapes including but not limited to round, square, rectangular, etc. Mixer 10 according to the preferred teachings of the present invention can perform mixing in single-use bags without contact with the product and without intrusion of the bag. Furthermore, mixer 10 according to the preferred teachings of the present invention can be utilized as a standard tank/vessel mixer without a single-use bag. Mixer 10 according to the preferred teachings of the present invention can be utilized in sanitary industries including but not limited to food, beverage, dairy, bakery, cosmetic, pharmaceutical, and biotech. Further, mixer 10 according to the preferred teachings of the present invention can be utilized in other industries including but not limited to the chemical industry.

Paddle 30 can be of any form according to need and according to the teachings of the present invention. Bag 150 can be sealed by any desired methods utilizing flexible boot 152. Support rod 106 can directly extend from frame 100 instead of vertical beam 104. In this case, horizontal beam 102 and vertical beam 104 can be omitted.

Figure 5:
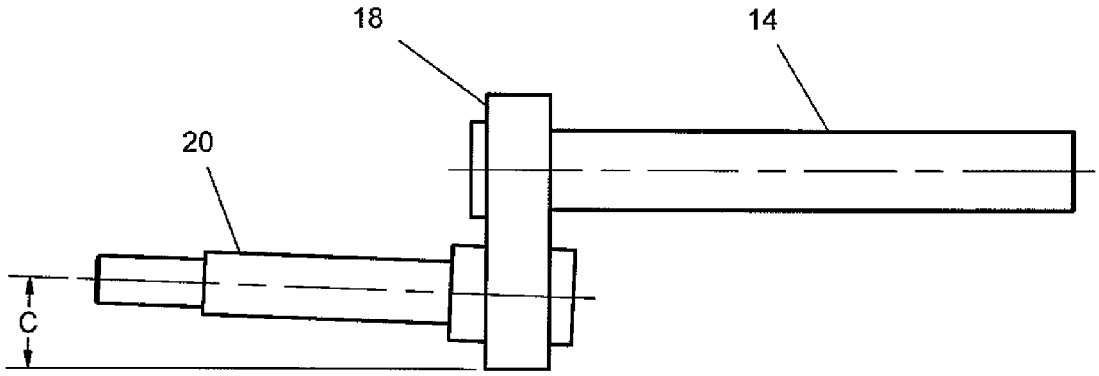
FIG. 5 shows a partial, side elevational view of a rotatable output, a circulating plate, and an offset pin of the mixer of FIG. 1.

Offset pin 20 defining the offset pin axis is spaced from and is preferably at a non-parallel angle C in a range of 0°-7° and in the most preferred form shown as 2° from the output axis of rotatable output 14. Angle C creates swaying movement (i.e., swaying angle B) of paddle 30 while moving up and down together with shaft 24. Specifically, if angle C is zero, swaying angle B of paddle 30 will be zero too. Furthermore, the third plane in which the lower end of shaft 24 moves will be exactly perpendicular to support rod 106 if angle C is zero. It is noted that offset pin 20 is shown as extending from circulating plate 18 toward the output axis of rotatable output 14 in FIG. 5. On the other hand, if offset pin 20 extends from circulating plate 18 away from the output axis of rotatable output 14, paddle 30 will sway in an opposite direction. By changing angle C and speed of rotatable output 14, movement of paddle 30 can be varied based on the sizing and adjustment in the system while the pattern remains unchanged.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Mixer comprising, in combination: a tank defining a compartment receiving product to be mixed; a shaft having an upper end and a lower end, with the lower end received in the compartment with a paddle attached thereto; and a swivel plate, with the shaft intermediate the upper and lower ends being slideably mounted to the swivel plate along a shaft axis, with the swivel plate being movably mounted to a support capable of motion on a support axis in a direction perpendicular to the shaft axis, with the upper end of the shaft being moved in two directions perpendicular to the shaft axis.

2. The mixer of claim 1 with the swivel plate being mounted to move in a swiveling manner relative to the support axis.

3. The mixer of claim 2 further comprising, in combination: a circulating plate rotatable about an output axis, with the upper end of the shaft rotatably coupled to the circulating plate about an offset axis spaced from the output axis.

4. The mixer of claim 3 further comprising, in combination: a coupler securely receiving the upper end of the shaft, with the offset axis extending through the coupler spaced generally perpendicular from the shaft.

5. The mixer of claim 4 wherein the offset axis is at a non-parallel angle to the output axis.

6. The mixer of claim 5 wherein the offset axis is at the non-parallel angle up to 7 degrees from the output axis.

7. The mixer of claim 6 wherein the offset axis is at the non-parallel angle of 2 degrees from the output axis.

8. The mixer of claim 6 wherein the offset axis extends from the circulating plate towards the output axis.

9. The mixer of claim 8 wherein the support axis and the output axis are spaced and parallel.

10. The mixer of claim 9 further comprising, in combination: a single-use bag received in the compartment, with the lower end of the shaft received in the single-use bag received in the compartment.

11. Method of mixing comprising:

placing a paddle of a lower end of a shaft in product, with the lower end including a paddle, with the shaft further including an upper end opposite to the lower end;

mounting the shaft for slideable movement along a shaft axis relative to a swivel plate;

moving the swivel plate in at least a first direction perpendicular to the shaft axis; and moving the upper end of the shaft in two directions perpendicular to the shaft axis.

12. The mixing method of claim 11 wherein moving the swivel plate comprises swiveling the swivel plate relative to a support axis.

13. The mixing method of claim 12 wherein moving the upper end comprises rotating a circulating plate about an output axis, with the upper end of the shaft rotatably coupled to the circulating plate about an offset axis spaced from the output axis.

14. The mixing method of claim 13 wherein rotating the circulating plate includes providing a coupler securely receiving the upper end of the shaft, with the offset axis extending through the coupler spaced generally perpendicular from the shaft.

15. The mixing method of claim 14 wherein rotating the circulating plate comprises rotating the circulating plate about the output axis which is at a non-parallel angle to the offset axis.

16. The mixing method of claim 15 wherein rotating the circulating plate comprises rotating the circulating plate about the output axis which is at the non-parallel angle up to 7 degrees from the offset angle.

17. The mixing method of claim 16 wherein rotating the circulating plate comprises rotating the circulating plate about the output axis which is at the non-parallel angle up to 2 degrees from the offset angle.

18. The mixing method of claim 16 wherein providing the coupler comprises providing the coupler with the offset axis extending from the circulating plate towards the output axis.

19. The mixing method of claim 16 wherein swiveling the swivel plate comprises swiveling the swivel plate relative to the support axis spaced from and parallel to the output axis.

20. The mixing method of claim 19 wherein placing the paddle comprises placing the paddle in product contained in a single-use bag received in a compartment defined by a tank.

* * * * *

UNITED STATES PATENT AND TRADEMARK OFFICE

CERTIFICATE OF CORRECTION

PATENT NO. : 8,152,362 B2
APPLICATION NO. : 12/580396
DATED : April 10, 2012
INVENTOR(S) : Brian J. Uhlenkamp and Shawn P. Pitt It is certified that error appears in the above-identified patent and that said Letters Patent is hereby corrected as shown below:

Title page, before item (51) Int. Cl., insert Item (60):

--Related U.S. Application Data
(60) Provisional application No. 61/106,189, filed on Oct. 17, 2008--.

Signed and Sealed this
Twenty-sixth Day of June, 2012

David J. Kappos

David J. Kappos
*Director of the United States Patent and Trademark Office*